United States Patent [19]

Vakil et al.

[11] 4,218,890

[45] Aug. 26, 1980

[54] VAPOR COMPRESSION CYCLE DEVICE WITH MULTI-COMPONENT WORKING FLUID MIXTURE AND IMPROVED CONDENSING HEAT EXCHANGER

[75] Inventors: Himanshu B. Vakil; John W. Flock, both of Schenectady, N.Y.

[73] Assignee: General Electric Company, Schenectady, N.Y.

[21] Appl. No.: 927,032

[22] Filed: Jul. 24, 1978

[51] Int. Cl.[2] ..... F25B 7/00; F25B 1/00; F25B 43/00; F25B 39/04

[52] U.S. Cl. ..... 62/114; 62/174; 62/502; 62/503; 62/509; 62/512

[58] Field of Search ..... 62/114, 502, 503, 509, 62/512, 174

[56] References Cited

U.S. PATENT DOCUMENTS

| | | | |
|---|---|---|---|
| 2,277,138 | 3/1942 | Newton | 62/114 X |
| 2,492,725 | 12/1949 | Ashley | 62/115 |
| 2,682,756 | 7/1954 | Clark et al. | 62/502 X |
| 2,794,322 | 6/1957 | Etherington | 62/114 |
| 2,794,328 | 6/1957 | Herrick | 62/114 X |
| 2,807,943 | 10/1957 | Lynch et al. | 62/115 |
| 2,986,898 | 6/1961 | Wood, Jr. | 62/512 X |
| 3,237,422 | 3/1966 | Pugh | 62/174 X |
| 3,500,656 | 3/1970 | Lofgreen et al. | 62/216 X |
| 3,636,723 | 1/1972 | Kramer | 62/503 |
| 4,003,215 | 1/1977 | Roach | 62/476 |

*Primary Examiner*—Lloyd L. King

*Attorney, Agent, or Firm*—Robert R. Schroeder; James C. Davis, Jr.; Paul R. Webb, II

[57] ABSTRACT

A vapor compression cycle device is described which includes a multi-component working fluid mixture, and an improved condensing heat exchanger. The vapor compression cycle device includes also a high-pressure liquid accumulator with an associated flow restricting device positioned between the condensing heat exchanger and the evaporating heat exchanger, and a liquid accumulator positioned between the evaporating heat exchanger and the compressor. A method is also described of modulating the capacity of such a device.

5 Claims, 3 Drawing Figures

Figure 1:
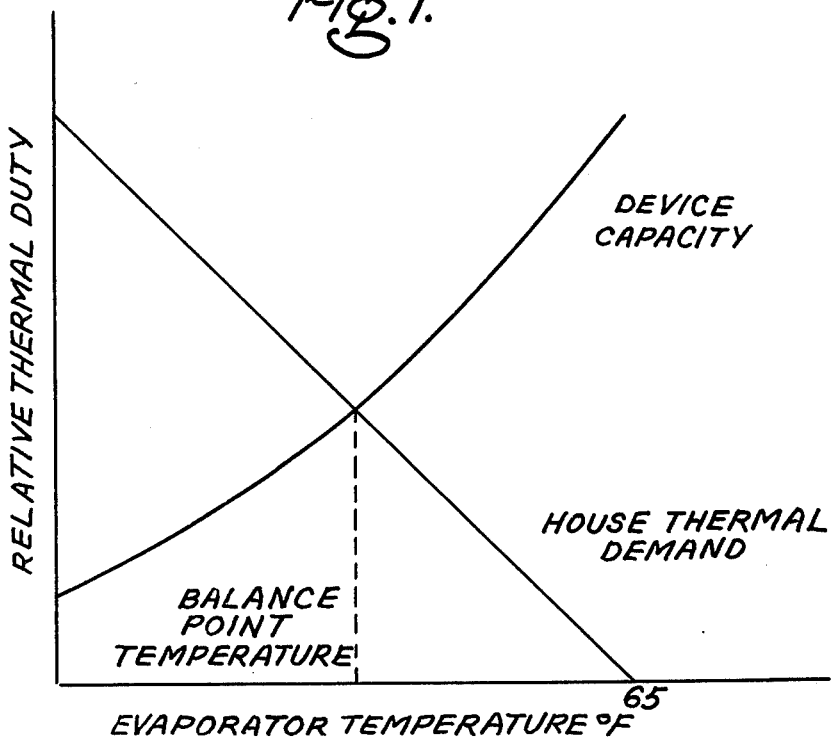

VAPOR COMPRESSION CYCLE DEVICE WITH MULTI-COMPONENT WORKING FLUID MIXTURE AND IMPROVED CONDENSING HEAT EXCHANGER

This invention relates to a vapor compression cycle device and to a method of modulating its capacity and, more particularly to such a device with a multi-component working fluid mixture and with an improved condensing heat exchanger and to a method of modulating its capacity.

A single refrigerant heat pump is described in U.S. Pat. No. 2,807,943 issued Oct. 1, 1957, under the title "Heat Pump Including Means For Controlling Effective Refrigerant Charge". The heat pump of the subject patent includes a refrigerant container positioned between the indoor heat exchanger and the flow restricting means for charging the effective refrigerant charge in the circuit.

A mixed refrigerant system is described in U.S. Pat. No. 2,492,725 issued Dec. 27, 1949, under the title "Mixed Refrigerant System". The subject heat pump includes a liquid receiver and expansion valve between the outdoor heat exchanger and the indoor heat exchanger.

A refrigerant system is described in U.S. Pat. No. 4,003,215, under the title "Absorption Refrigeration System". The subject system utilizes a pair of fluorocarbon compounds in which one fluid is separated from the other fluid by a distillation process. The separated fluid is circulated through the refrigeration system.

Reference is made to copending patent application Ser. No. 926,510, filed July 20, 1978, which is entitled "Vapor Compression Cycle Device With Multi-Component Working Fluid Mixture And Method of Modulating Its Capacity". This copending application describes a vapor compression cycle device with a working fluid mixture, a high-pressure liquid accumulator with an associated flow restricting device positioned between the condensing heat exchanger and the evaporating heat exchanger, and a low-pressure-liquid accumulator positioned between the evaporating heat exchanger and the compressor. This application is assigned to the same assignee as the present application.

Our present invention is directed to a vapor compression cycle device which is opposed to the above patents in that it includes a multi-component working fluid mixture, a high-pressure-liquid accumulator with an associated flow restricting device positioned between the condensing heat exchanger and the evaporating heat exchanger, and a low-pressure-liquid accumulator positioned between the evaporating heat exchanger and the compressor. Our present invention is an improvement over the above-identified copending application Ser. No. 926,510, in that it provides an improved condensing heat exchanger.

The primary objects of our invention are to provide an improved vapor compression cycle device with multi-component working fluid mixture and with an improved condensing heat exchanger, and to provide a method of modulating the capacity of such a device whether operating in a heating or in a cooling mode.

In accordance with one aspect of our invention, a vapor compression cycle device includes a multi-component fluorocarbon working fluid mixture and three rows of refrigerant tubes connected sequentially from back row to front row.

Figure 3:
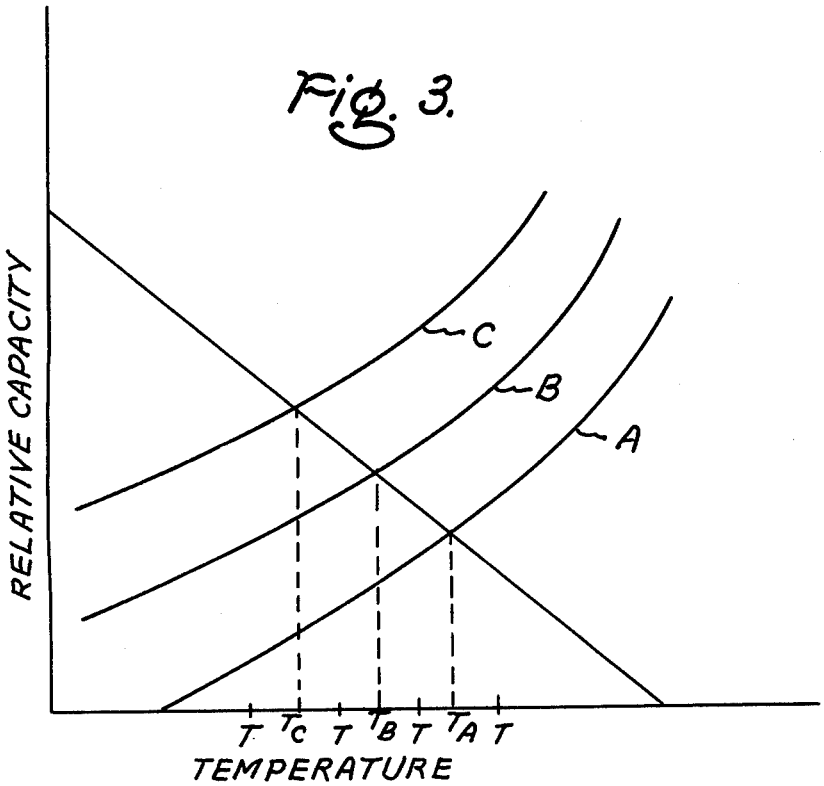
Figure 2:
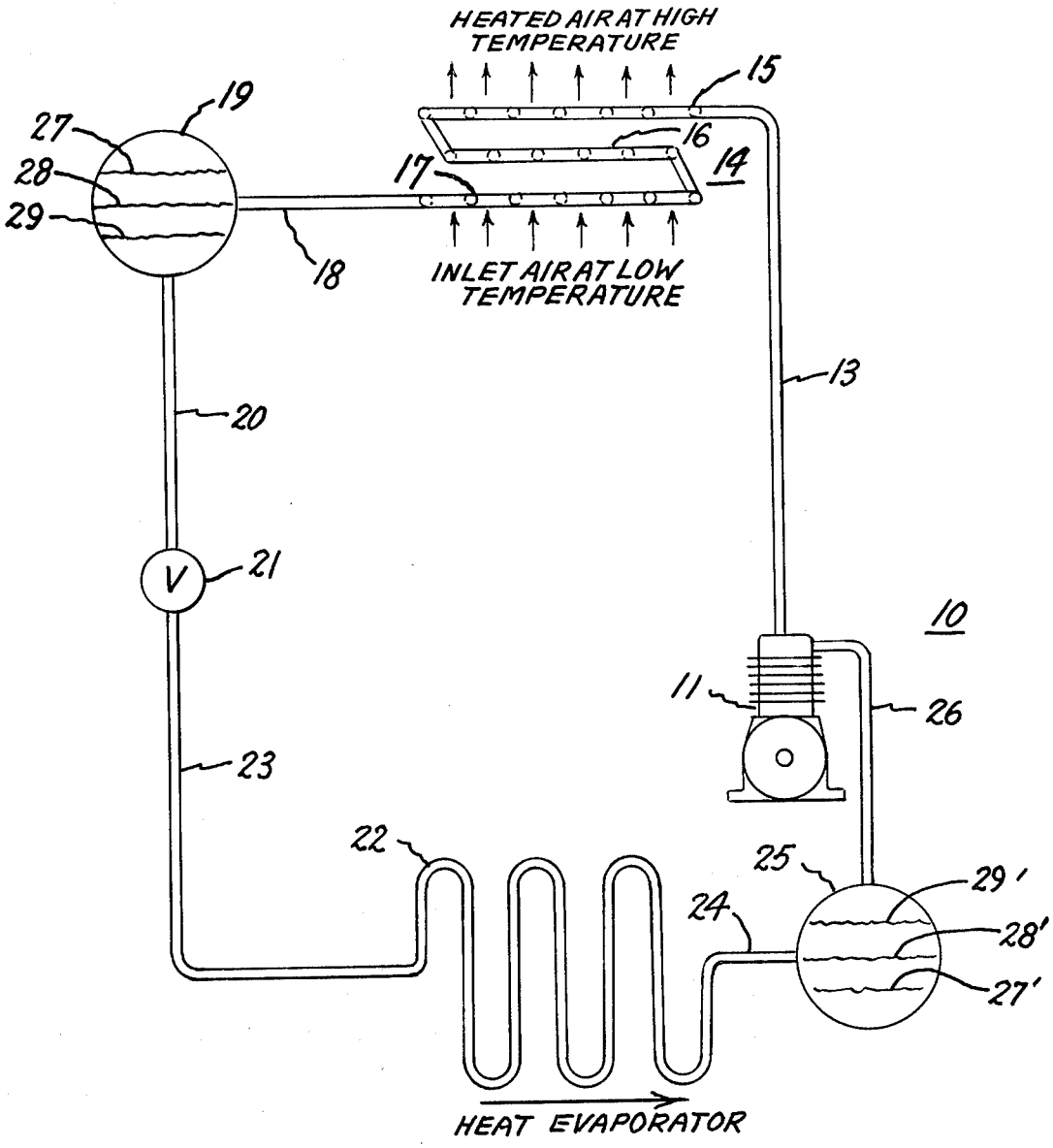

These and various other objects, features and advantages of the invention will be better understood from the following description taken in connection with the accompanying drawing in which:

FIG. 1 of the drawing is a schematic graph exhibiting a typical contrast between the house thermal demand and the heating capacity of a vapor compression cycle device operating in the heating mode as a function of evaporator temperature;

FIG. 2 is a schematic view partially in section of a vapor compression cycle device made in accordance with our invention; and FIG. 3 is a schematic graph demonstrating relative capacity versus evaporator temperature in our method of modulating the capacity of our vapor compression cycle device.

In FIG. 1, which is a schematic graph, there is exhibited a typical contrast between the house thermal demand and vapor compression cycle device capacity as a function of evaporator temperature. Conventional device designs suffer from a major disadvantage in the capacity versus evaporator temperature characteristics of the devices. Ideally, one would like the device to have a capacity versus evaporator temperature characteristic resembling that of the house. Unfortunately, in case of existing devices there is a wide mismatch in the two characteristics. As consequences, above the balance point temperature there are two sources of inefficiencies; one existing from an overloading of the heat exchangers that operate with high temperature differences resulting in associated thermodynamic penalties, and the other arising out of the startup and shutdown transients resulting from a reduced operational duty factor. Below the balance point temperature, additional inefficiencies result from the necessity to utilize additional resistance heating at associated low efficiencies in order to make up the difference between the house demand and the device supply.

Our invention provides an improved vapor compression cycle device that has a higher capacity for a lower evaporator temperature over the bulk of heating season.

In FIG. 2 of the drawing, there is shown a vapor compression cycle device 10 with a multi-component fluorocarbon working fluid mixture and with an improved condensing heat exchanger made in accordance with our invention. Device 10 in the heating mode has a compressor 11 for the working fluid mixture. Tube 13 connects compressor 11 to the inlet side of improved condensing heat exchanger 14. Exchanger 14 is shown with three rows, back row 15, middle row 16, and front row, 17 of working fluid tubes which are connected sequentially from the back row to the front row. Thus, tube 13 is connected to back row 15 of exchanger 14. Tube 18 connects the outlet side of front row 17 of condensing heat exchanger 14 to a high-pressure liquid accumulator 19. Tube 20 connects accumulator 19 to an associated flow restricting device 21. An evaporating heat exchanger 22 is connected to flow restricting device 21 by a tube 23. A tube 24 connects the outlet side of exchanger 22 to a low-pressure liquid accumulator 25. Compressor 11 is connected to the outlet side of accumulator 25 by a tube 26. Thus, a closed system is provided containing a multi-component mixed working fluid that flows cyclicly through the entire system.

In high-pressure liquid accumulator 19, three different liquid levels 27, 28 and 29 are shown which exist at different stages of the heating mode which will be discussed below in more detail. Similarly, in accumulator 25, three different liquid levels 27', 28', and 29' are shown which exist at different stages of the heating mode which will be discussed below in more detail.

Our vapor compression cycle device has improved capacity versus evaporator temperature characteristics. The multicomponent working fluid mixture eliminates or minimizes thermodynamic penalty associated with the evaporator heat exchanger pressure drop and the related temperature drop. The improved condensing heat exchanger achieves a reduced degradation of the delivered heat. Our device has a high-pressure liquid accumulator with an associated restrictive flow device positioned between the condensing heat exchanger and the evaporating heat exchanger, and a low-pressure accumulator positioned between the evaporating heat exchanger and the compressor. This device matches the house thermal demand over a range of evaporator temperatures. This range can be selected to give maximum benefit during the bulk of heating season by reducing vastly the disadvantages inherent in additional heating below conventional balance point temperatures and thermal degradation through heat exchanger overloading above the balance point temperatures which is shown in FIG. 1 of the drawing.

Various multi-component working fluid mixtures can be employed. Such mixtures, which have two or more components, must have different vapor pressures and the mixtures components must be miscible over the range of operation. We prefer multi-component fluorocarbon working fluid mixtures. Such multi-components can be selected from such mixtures described in above-referenced U.S. Pat. No. 4,003,215. As opposed to this patent wherein one working fluid is separated from the other working fluid by distillation prior to circulation in the refrigerant system, the present vapor compression cycle device circulates the working fluid as a mixture. The capacity versus evaporator temperature characteristics of a single component working fluid is limited by the dependence of the working fluid vapor pressure on the heat exchanger. The present invention uses advantageously the composition of the mixed working fluid to alter the compressor molar flow rate to accomodate the changes in evaporator temperature.

During the heating mode of vapor compression cycle device 10, compressor 11 circulates mixed working fluid vapor through tube 13 to sequentially connected tubes rows 15, 16, and 17 of condensing heat exchanger 14. The mixed working fluid flows from tube row 17 of exchanger 14 through tube 18 to a high-pressure accumulator 19. A flow restricting device in the form of an expansion valve 21 controls the flow of mixed working fluid liquid from accumulator 19 through tube 20, valve 21 and tube 23 to evaporating heat exchanger 22. The mixed working fluid vapor and liquid flow from exchanger 22 through tube 24 to accumulator 25. Compressor 11 receives mixed working fluid, mostly as vapor, from accumulator 25 through tube 26 to complete the heating mode.

As it is shown in FIG. 2 of the drawing, high-pressure accumulator 19 has mixed working fluid levels 27, 28, and 29 indicated schematically. In low-pressure accumulator 25, the mixed refrigerant levels are shown as 27', 28', and 29'. When level 27, 28, or 29 is accomplished in high-pressure accumulator 19, the increasing level of the mixed working fluid in accumulator 25 is 27', 28', or 29'. As described in copending patent Ser. No. 926,510 the following description discusses how these levels are achieved and their effect on modulating the capacity of the vapor compression cycle device during its heating mode. At a high evaporator temperature for the heating mode, as shown in FIG. 1 of the drawing, expansion valve 21 in FIG. 2 of the drawing is controlled by conventional equipment to adjust the flow rate of the mixed working fluid from accumulator 19 whereby a level 27 of refrigerant is attained in accumulator 21. This control of expansion valve 21 will deplete mixed working fluid in accumulator 25 to a level shown as 27'. In this manner, the mixed working fluid liquid in low-pressure accumulator 25 is enriched in the high boiling point working fluid component and the vapor pressure at evaporating heat exchanger 22 is reduced to its lowest level. This results in the lowest molar flow rate through the compressor and hency the lowest capacity for this evaporator temperature. As the evaporator temperature drops, exchange valve 21 is controlled to allow increasing quantities of the mixed working fluid from high-pressure accumulator 19 to pass through heat exchanger 22 into accumulator 25 thereby providing a level shown as 28'. This increase in flow of mixed working fluid from accumulator 19 through exchanger 22 to accumulator 25 enriches the working fluid in the lighter or lower boiling point working fluid component. The total pressure in accumulator 25 increases with a resulting increase in the device capacity and in the molar flow rate through compressor 11. As the temperature continues to drop, exchange valve 21 allows the liquid in accumulator to fall to a level 29 and increases the level in accumulator 25 to 27'. In this manner, the process of increasing or enriching the refrigerant in its lower boiling point component is continued. This increases the compressor inlet density with increased molar pumping flow rate of the compressor. As the temperature drops further, exchange valve 21 allows all of the working fluid liquid in accumulator 19 to be depleted, which refrigerant passes through exchanger 22 and into accumulator 25 with an associated increase in the molar pumping flow rate of the compressor to its maximum value yielding the maximum device capacity for this lower evaporating temperature. Thus, our device modulates its capacity versus the evaporator temperature to match indoor thermal demand. As the evaporator temperature increases in the heating mode, modulation is obtained by initially decreasing the flow rate of the mixed working fluid from accumulator 19 which is controlled selectively by flow restricting device 19. In this manner, the mixed fluid level in accumulator 25 may be restored to level 28' or 27' in response to increasing evaporator temperature.

In FIG. 3 of the drawing, the schematic graph demonstrates the flexibility of capacity modulation of our vapor compression cycle device. "A", "B", and "C" represent vapor compression cycle device capacity curves corresponding to successively increasing liquid levels in the low-pressure accumulator. "$T_A$", "$T_B$", and "$T_C$" represent three balance point temperatures in descending temperatures. The "T's" represent various evaporator temperatures during the heating mode of the device.

For the purpose of a direct comparison of the present device with a one-component heat pump, curve B is the equivalent of a single component device capacity curve. The advantages of this invention are evident in the following comparisons in each of the four temperature ranges:

$T > T_A$: The lower capacity of curve A implies savings due to a reduced loading of the heat exchangers and a reduced cycling loss.

$T_A > T > T_B$: There is no on-off cycling of the multi-component device and, furthermore, the heat exchanger overloading is eliminated.

$T_B > T > T_C$: The auxilliary heating required in a one-component system is eliminated by the gradually increasing capacity of the multi-component cycle, and $T_C > T$: The auxilliary heating is reduced by the difference in capacities shown by curves C and B with resultant improvements in the overall system.

Thus, the temperature range $T_A$–$T_C$ can be chosen to encompass the bulk of the heating season by the flexibility in the number of working fluids employed and their vapor-pressure versus temperature characteristics.

Our improved evaporating heat exchanger achieves a reduced degradation of the delivered heat. Present evaporating heat exchangers employ generally three rows of working fluid tubes which are connected in parallel between device compressor and an expansion valve. Present devices are based also on a simple vapor compression cycle with a single fluorocarbon working fluid. The working fluid vapor in the present type of devices pass from the compressor outlet through two feed tubes through three rows of closed working fluid tubes forming the condensing heat exchanger. Inlet air at a low temperature passes in a cross-flow direction through the rows of the heat exchanger to provide heated air at a high temperature. A source of cycle inefficiency is the temperature mismatch inherent in the transfer of heat from a constant temperature condensation of the refrigerant to room air that enters at 65° F. and leaves at 100° F.

In the evaporating heat exchanger of the present invention, we employ three rows of working fluid tubes. However, it will be appreciated that other numbers of rows can be employed. We found that we can improve the coefficient of performance of our vapor compression cycle device with an improved condensing heat exchanger and with the use in the device of a multi-component working mixture. In this manner, we achieve simultaneously a matching of the indoor heat exchanger and the outdoor heat exchanger with appropriate pressure drop. Our condensing heat exchanger employs also an air cross-flow as in conventional devices.

In our device, the condensing heat exchanger comprises three or more rows of closed working fluid tubes. However, we improve the performance of the condensing heat exchanger and resulting device by connecting sequentially the rows from the back row to the front row. Further, the compressor outlet is connected to the back row while the front row is connected to the high-pressure accumulator. In operation, during the heating mode, the high-pressure refrigerant mixture vapor is circulated from the compressor outlet to the back row of closed working fluid tubes, to the middle row or rows of tubes, and then to the front row of tubes. The cooler inlet air cross-flow passes from the front tube row through the middle row or rows and passes the back row to the space to be heated. The higher working fluid temperature exists in the back tube row while the temperature decreases to the front tube row. The desuperheating heat and initial condensation begins in the middle row or rows. The final low-temperature condensation occurs in the front tube row where the air flow temperature is lowest. Thus, the cooler inlet air passes over the cooler tube rows first and then over the hottest row resulting in performance improvement of the device.

In the operation of our device during its heating mode, a multi-component working fluid mixture is compressed, the mixture vapor is condensed, the mixture liquid is stored under high pressure, the flow rate of the mixture is controlled from storage in response to changes in evaporator temperature, the mixture is evaporated, unevaporated mixture is stored under low pressure, and the flow rate of compression is controlled by the density of the vapor of the mixture under low-pressure storage.

The capacity of the heat pump is modulated during its heating mode by circulating a multi-component working fluid mixture vapor from a compressor to an improved sequentially connected condenser. The liquid from the condenser is circulated to a high-pressure accumulator. The mixture is circulated from the accumulator to an evaporator. The flow of the mixture from the accumulator to the evaporator is controlled selectively in response to changes in the evaporator temperature by an associated flow restricting device. The mixture is then flowed to a low-pressure accumulator. The density of the vapor in equilibrium with the liquid mixture in the low-pressure accumulator controls the rate of compression or the molar flow of the mixture to and through the compressor.

At the higher outdoor temperatures, the restricted flow of the mixed working fluid from the high-pressure accumulator results in the mixed working fluid, which is circulated to the evaporator, being enriched in the high boiling point working fluid component. As the evaporator temperature decreases, the increase of mixture flow from the high-pressure accumulator enriches the working fluid mixture in the low boiling point working fluid component. The additional flow of working fluid mixture through the evaporator and to the low-pressure accumulator results in a pressure increase in the low-pressure accumulator thereby increasing the molar pump flowing rate of the compressor. Thus, our method provides for modulation of the capacity of our device during its heating mode.

While other modifications of the invention and variations thereof which may be employed within the scope of the invention have not been described, the invention is intended to include such as may be embraced within the following claims:

What we claim as new and desire to secure by Letters Patent of the United States is:

1. A method of modulating the capacity of a vapor compression cycle device which comprises compressing a multi-component working fluid mixture, condensing the mixture vapor by sequential circulation from its hottest region to its coolest region, storing the mixture liquid under high pressure, controlling the flow rate of the mixture from storage, evaporating the mixture, storing the unevaporated mixture under low pressure, and controlling the flow rate of compression by the density of the vapor of the mixture under low pressure.

2. A method of modulating the capacity of a vapor compression cycle device which comprises compressing a multi-component working fluid mixture, circulating the mixture vapor to the hottest region of a condenser, circulating sequentially the mixture vapor through the condenser from its hottest region to its coolest region, circulating the mixture liquid from the coolest region of the condenser to a high-pressure accumulator, controlling the circulation of the mixture from the accumulator to an evaporator, circulating the mixture from the evaporator to a low-pressure accumulator, circulating the mixture from the low-pressure accumulator to the compressor, and controlling the flow rate of the mixture from the low-pressure accumulator to and through the compressor by the density of the vapor of the mixture in the low-pressure accumulator.

3. A method of modulating the capacity of a vapor compression cycle device as in claim 2, in which the mixture is a multi-component fluoro-carbon working fluid.

4. A vapor compression cycle device comprising a closed working fluid circuit, a multi-component working fluid mixture in the circuit, the closed circuit comprising a compressor, a condensing heat exchanger in heat exchange relationship with a flow of cooling fluid and comprising a plurality of different temperature tube rows, including at least a front tube row and a back tube row, the tube rows connected together sequentially in order of decreasing temperature from the back tube row to the front tube row and disposed in series flow communication with the flow of cooling fluid in the reverse order of the sequential connection of the tube rows, the compressor connected to the back tube row of the condensing heat exchanger, a high-pressure accumulator connected to the front tube row of the condensing heat exchanger, a flow restricting device connected to the high-pressure accumulator, an evaporating heat exchanger connected to the flow restricting device, a low-pressure accumulator connected to the evaporating heat exchanger, and the low-pressure accumulator connected to the compressor.

5. A vapor compression cycle device as in claim 4, in which the mixture is a multi-component fluoro-carbon working fluid.

* * * * *